US005101736A

United States Patent [19]

Bommarito et al.

[11] Patent Number: 5,101,736

[45] Date of Patent: Apr. 7, 1992

[54] ADJUSTABLE SURFACE DESK FOR COMPUTERS

[76] Inventors: Paul F. Bommarito, 10684 Martinwood Way; Vincent A. Laporta, 20129 Suisun Dr., both of Cupertino, Calif. 95014

[21] Appl. No.: 525,883

[22] Filed: May 17, 1990

[51] Int. Cl.[5] ..... A47F 5/12

[52] U.S. Cl. ..... 108/7; 108/10; 108/96; 108/147; 312/194

[58] Field of Search ..... 312/194; 108/3, 5, 7, 108/10, 17, 20, 90, 93, 96, 147

[56] References Cited

U.S. PATENT DOCUMENTS

| | | | |
|---|---|---|---|
| 3,838,694 | 8/1974 | Mestler et al. | 108/10 |
| 4,440,096 | 4/1984 | Rice et al. | 108/20 |
| 4,515,086 | 5/1985 | Kwiecinski et al. | 108/96 |
| 4,640,485 | 2/1987 | Day et al. | 248/422 |
| 4,669,789 | 6/1987 | Pemberton | 312/7.2 |
| 4,717,112 | 1/1988 | Pirkle | 248/639 |
| 4,735,467 | 4/1988 | Wolters | 312/29 |
| 4,766,422 | 8/1988 | Wolters et al. | 340/700 |
| 4,781,126 | 11/1988 | Lochridge | 108/6 |
| 4,805,538 | 2/1989 | Fisher et al. | 108/92 |
| 4,828,342 | 5/1989 | Stefan | 312/21 |

FOREIGN PATENT DOCUMENTS 2480581 10/1982 France ..... 108/96

OTHER PUBLICATIONS

American National Standard for Human Factors Engineering of Visual Display Terminal Workstations, pp. 31-37 and 41-50 ('90).

*Primary Examiner*—Kenneth J. Dorner
*Assistant Examiner*—Gerald D. Anderson
*Attorney, Agent, or Firm*—Schneck & McHugh

[57] ABSTRACT

An adjustable desk having two centrally located motorized platforms, one in front of the other, with the front platform adapted to support a keyboard and the rear platform adapted to support a video display terminal. Both platforms operate independently of the other. Each of these platforms can have its elevation adjusted over a wide range. The platform for supporting a keyboard may also have its tilt adjusted through a motorized means. The platform for the keyboard comprises three planar sections stacked on top of one another. The two lower sections are hingdly attached to one another along their front edge. The top section is slidably connected to the middle section. Switches to control the adjustent of these platforms is found on the front of the desk.

13 Claims, 3 Drawing Sheets

ADJUSTABLE SURFACE DESK FOR COMPUTERS

TECHNICAL FIELD

The present invention relates to adjustable desks, and more particularly to desks with movable surfaces.

BACKGROUND ART

Desktop computers have become an essential piece of office equipment in many businesses and industries, as well as in the home. Indeed many workers now spend much of their time working on a computer, while for others the time spent using a computer is only occasional. In the latter situation the computer may be shared by several users.

Frequently these desktop computers have been placed on top of standard office desks, which were not particularly designed to accommodate a desktop computer. Therefore, it is not surprising that such an arrangement does not always provide the most ergonomic positioning of the computer's input and output devices, e.g., video display terminal (VDT) and keyboard, relative to the user. In response to this problem various desks specifically designed to accommodate computer equipment and associated peripheral devices have been designed.

In U.S. Pat. No. 4,640,485 Day et al. disclose an adjustable monitor stand for use on a standard office desk, which allows for height adjustment as well as swivel and tilt of the monitor.

In U.S. Pat. No. 4,669,789 Pemberton discloses a computer desk having a pivotal compartment for housing a monitor, and an extendable shelf for supporting a keyboard.

In U.S. Pat. No. 4,717,112 Pirkle discloses a support frame for use on a standard office desk, which has a fixed height video display support surface and a slidable shelf unit for supporting a keyboard and digitizer surface.

In related U.S. Pat. Nos. 4,766,422 and 4,735,467 Wolters et al. disclose a computer desk having a motorized height adjustable flat screen VDT, a hidden compartment for housing a keyboard, and various side compartments for housing other peripheral devices.

In U.S. Pat. No. 4,781,126 Lochridge discloses an adjustable desk-top assembly which has a motorized adjustable work surface capable of assuming a slope and having the general form of a semi-circle.

In U.S. Pat. No. 4,828,342 Stefan discloses a convertible computer desk which may be converted from a conventional appearing desk configuration into a configuration in which computer equipment, such as a monitor may be raised from an internal storage compartment to desktop level. The desk also contains a concealable keyboard support shelf.

A few manufacturers of modular office furniture offer computer workstation units having adjustable support surfaces. For example, Inotec Systems, Inc. manufactured an electrically adjustable stand, model EDP2100, having dual surfaces with independently adjustable height and tilt. The forward surface is also slidable. Haworth, Inc., has proposed a workstation stand having independently motorized support surfaces with height adjustment only. While the modular workstation stands are quite functional in many respects, they fail to offer much in the way of desktop work space. Indeed, a support surface which is at a good height for a keyboard is often too low to be conveniently used for desktop activities. Another characteristic of these units is their non-traditional, more modern appearance. Preferences in furniture styles vary widely with many people, especially executives and professionals, preferring more traditional styles. How a piece of furniture looks is often more important to the purchaser than how it functions.

While it is true that the above computer desks and monitor stands offer some degree of adjustability, they do not, however, offer the full degree of adjustability necessary when considering the entire computer desk or work station as an integrated system, i.e., a seated user, computer desk, VDT and keyboard. This lack of adequate adjustability is apparent by noting that the keyboard supports and shelves of the prior art have essentially a fixed height relative to the floor. This fact is important when considering size differences between users and the height at which they sit most comfortably.

Seating is an integral part of the overall work environment. Indeed, viewing the work are as an integrated system brings out the importance of how adjustable seats interact with the other furniture and computer components, and how these interactions influence user comfort. The primary purpose of seating is to provide support and stability for the seated person. A well-designed chair will favorably affect posture, circulation, the amount of effort required to maintain posture, and the amount of strain on the spine. Furthermore, a well-designed chair will provide comfort for static posture as well as allowing for freedom of movement. To accomplish these purposes, the height of a seat should allow the user to place his or her feet firmly on a support surface to provide stability for the seated posture and provide adequate lower leg support. Therefore, a user that may ergonomically have the correct seat height may be in an uncomfortable position relative to the fixed height of the keyboard.

It has been shown that incorrect positioning of the user relative to the keyboard is a significant cause of carpal tunnel syndrome, an inflammatory condition of the carpal nerve in the wrist. Therefore it is important to provide the user with computer furniture which will allow him or her to be seated at the ergonomically correct seat height and with an ergonomically proper position relative to the keyboard.

Another important aspect of user comfort is eye strain. Standards and guidelines aimed at reducing the problems, e.g., headaches, tired eyes, etc., related to frequent use of a VDT have been set forth in ANSI/HFS 100-1988 (American National Standards Institute/Humane Factors Society). An important factor affecting eye strain is the relative positional relationships between the keyboard, VDT and user. A consideration within these relationships is the viewing distance between the user, and the VDT and keyboard. A comfortable viewing distance for the VDT is a function of not only the size of the displayed characters but also of the user's ability to maintain focus and alignment of the eyes. Visual skills vary among people, and some people may use corrective lenses for some visual deficiencies.

In particular, as people get older their ability to focus on an object that is close deteriorates because of hardening of the lenses. Indeed few people over sixty years old can focus on objects closer than forty inches without corrective lenses, such as bifocals. Because of the special nature of bifocals and other multisegmented eyeglasses, it is often difficult to position the keyboard and VDT relative to the user in a comfortable arrangement. This task is made even more difficult given that it is advantageous to locate frequently viewed surfaces, such as a document holder for reference material and the display screen, at or near the same optical distance. Thus, the eye-to-document holder distance and the eye-to-VDT distance should be about the same.

A concern with adjustable computer desks is the manner in which the adjustments are made. Frequently manual operations are required to adjust the desk. This may not only be inconvenient, but these operations often require the user to lean or bend over the desk. This may place undue stress on the user's lower back which may cause back injury. Moreover, in situations where the desk is used by several different users, manual adjustment may be viewed by these users to be so burdensome that whatever position the desk is in will be "lived with". Hence these users may not be in the most ergonomic position for using the desk.

In view of the above, it is therefore an object of the present invention to provide a traditional appearing desk which is designed for supporting components of a computer system, and which is ergonomically comfortable both physically and optically for a wide range of users.

It is another object of the present invention to provide a desk for supporting components of a computer system which is convenient to adjust.

SUMMARY OF THE INVENTION

The above objects have been achieved by a traditional looking desk in which the monitor and keyboard of a computer system rest on surfaces which are fully adjustable relative to one another and relative to a user. The desk contains two centrally located motorized platforms, one in front of the other. The platforms occupy a cutout section of the top surface of the desk. The front platform is for supporting the keyboard, while the rearward platform is for supporting the VDT or monitor. Both platforms operate independently of the other.

The platform for the keyboard comprises three planar sections stacked on top of one another. The two lower sections are hingedly attached to one another along their front edge. The top section is slidably connected to the middle section. A motor and threaded screw or the like is coupled to the middle section so that it may be tilted relative to the bottom section. This gives the keyboard platform motorized tilt adjustment. The whole keyboard platform is also coupled to another motorized assembly which provides elevational adjustment to the keyboard platform.

The rearward platform similarly is coupled to a motorized assembly which provides elevational adjustment. Both platforms may be lowered several inches below the top surface. Since many VDTs come with tilt and swivel bases or are readily available, a VDT supported on the rearward platform is generally fully adjustable.

Switches on the front of the desk are used to control the motors noted above. A master or safety switch may be included so that adjusting the desk is somewhat "child-proof". Visual indications of platform height and keyboard tilt may also be provided on the desk to aid in finding a comfortable position or in returning the desk to a known position.

A primary advantage of the present desk is that an ergonomically comfortable position both physically and optically can be obtained for many users. Additionally, users who wear multisegmented lenses can also be comfortably accommodated. Providing comfortable computer work stations has become increasingly important both as computer use becomes more common and as the work force which uses computers gets older. Finally, adjustments to the present desk can be made easily and quickly because these adjustments are motorized. These and other advantages are described more fully in relation to the drawings.

BEST MODE FOR CARRYING OUT THE INVENTION

Figure 1:
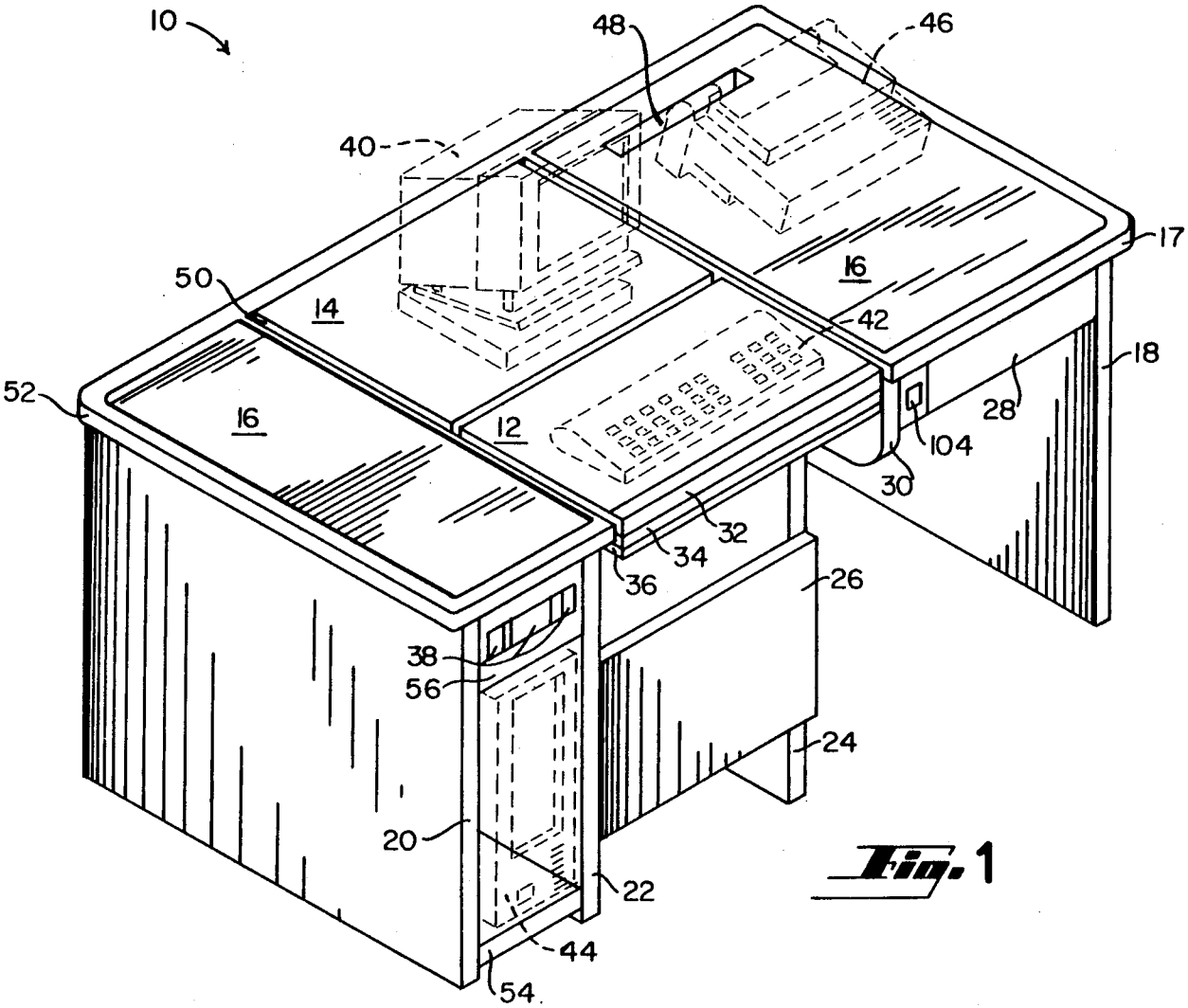
FIG. 1 is a perspective view of a computer desk in accord with the present invention.

Referring to FIG. 1, a desk 10 is shown having adjustable support platforms 12 and 14. The support platform 12 is designed to accommodate a keyboard 42, shown in phantom. The support platform 14 is designed to accommodate a video display terminal (VDT) or monitor 40, also shown in phantom. On either side of the support platforms 12 and 14 is a horizontal member 52 having a top surface 16. Together the platforms 12 and 14 and the top surface 16 form the top of the desk 10. The top surface 16 may be used for typical desktop activities and/or to support peripheral devices such as a printer 46, also shown in phantom. In association with the printer 46, a paper slot 48 may be provided in the top surface 16 for feeding continuous paper to the printer 46.

The horizontal member 52 is supported by side walls 18, 20, 22 and 24. These side walls stand upright and are generally parallel to one another. Lending support to the side walls is a back wall, not shown. Additional support is provided by face plate 26 and slidable bottom support shelf 54. The structural members of the desk 10 may be made of solid woods, veneers and high pressure laminates as is commonly used in furniture.

The desk 10 has essentially a conventional structure with the exception of the support platforms 12 and 14. Each of these support platforms and their associated lift mechanisms are housed in well-like cavities in the desk. The lift mechanisms, discussed more fully in relation to FIGS. 2–4, raise and lower the support platforms 12 and 14 independently of each other. Independent height adjustment of the platforms gives the desk 10 the degree of adjustability needed to ergonomically position the keyboard and VDT to a user.

Preferably the keyboard support platform has a range of adjustment of at least 5.0 inches. The floor-to-keyboard height is preferably at least within the range of 23–28 inches. Such a height range would provide a comfortable keyboard height for a large cross section of users. In studies used to define ANSI/HFS 100–1988 guidelines, it was found that a wide range of forearm angles, defined by the angle between the upper arm and the forearm, resulted in equal preference and performance. The angle between the upper arm and the forearm should be greater than 70° and less than 135°. Typically this results in the keyboard platform 12 being lower than the top surface 16.

The keyboard support 12 is also adjustable tiltwise and is extendable. These features are provided by three stacked planar members 32, 34 and 36, details of which are discussed more fully in relation to FIGS. 2 and 3.

To provide comfortable viewing the height of the VDT support platform 14 should permit the entire primary viewing area of the display 40 to be located between zero and 60 degrees below the horizontal plane passing through the eyes of the user. The range of vertical adjustment is preferably at least 5.0 inches, which is the same as for the keyboard support platform 12.

Additional features of the desk 10 include an upright storage compartment for the CPU 44, which is defined by the side walls 20 and 22, and slidable bottom support shelf 54, which allows removal of the CPU unit for service. The top of the storage compartment is defined by a switch plate 56 in which switches 38 are set. The computer unit 44 shown stored in this compartment, in phantom, is in an upright position. Other storage areas on the desk include a slidable drawer 28 which is supported between drawer support 30 and the side wall 18.

Figure 5:
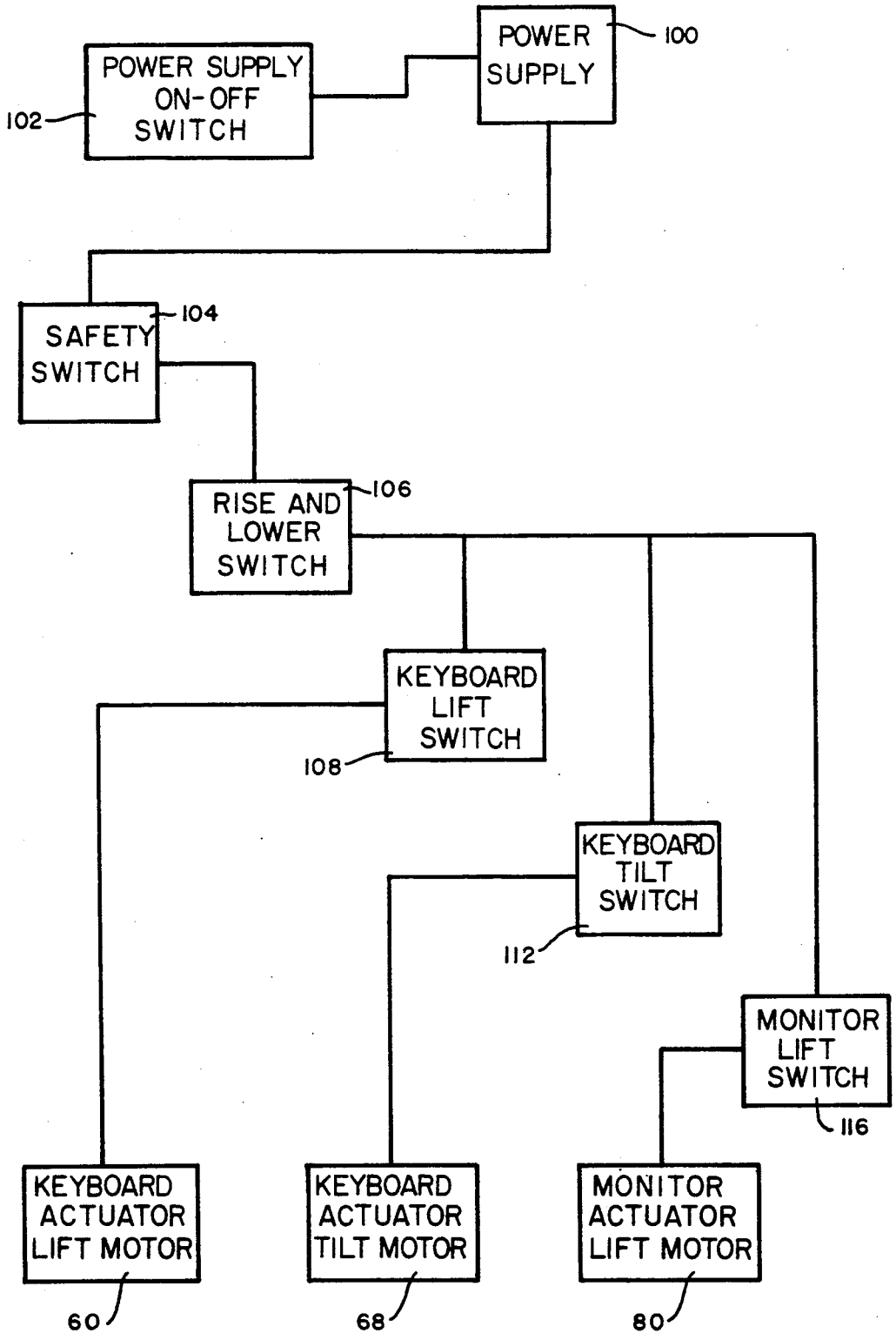
FIG. 5 is a block diagram of the control switches in accord with the present invention.

In operation, the switches 38 are used to actuate motors which are associated with the lift and tilt mechanisms of the support platforms 12 and 14. FIG. 5 illustrates the function of these switches.

Figure 3:
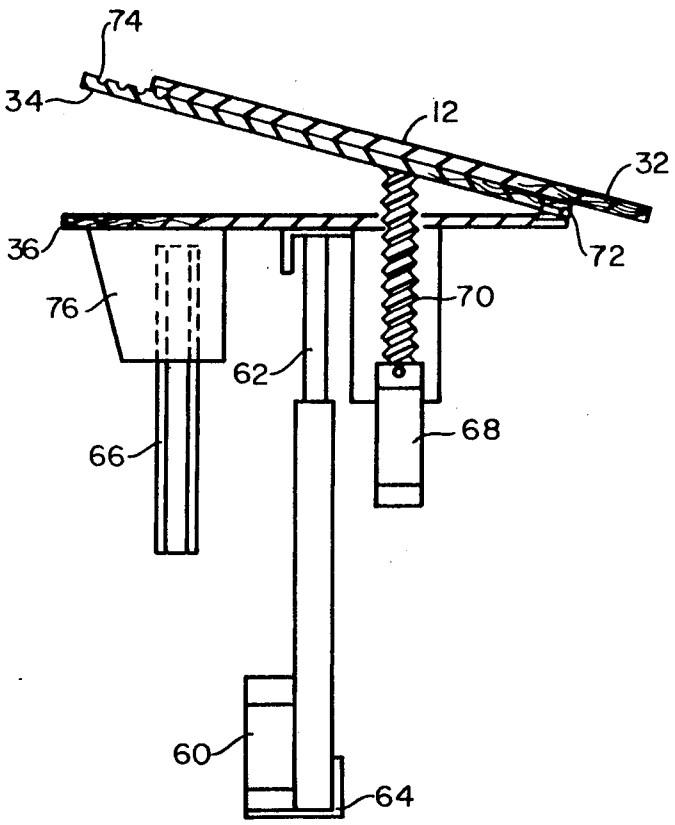
FIG. 3 is a side plan view of the keyboard platform of FIG. 2 shown in a tilted and slided position.
Figure 2:
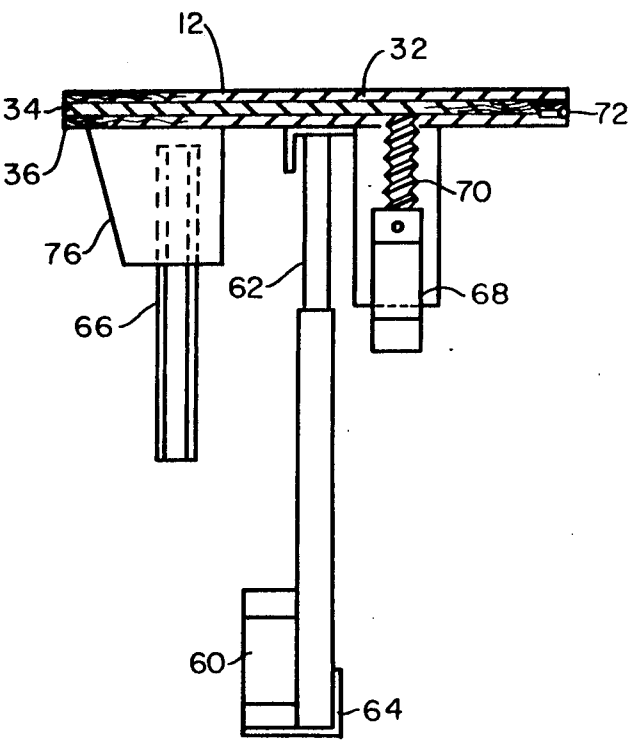
FIG. 2 is a side plan view of the keyboard platform of FIG. 1.

Referring now to FIGS. 2 and 3, details of the lift and tilt mechanisms of the keyboard support platform 12 are shown. The support platform 12 has a top planar member 32 which is slidably coupled to middle planar member 34, which in turn is hingedly attached by hinge 72 to bottom planar member 36. The top planar member 32 may be slidably coupled to the middle planar member using a track assembly, as is common to slidable keyboard trays. Hingedly attaching the middle planar member 34 and the bottom planar member 36 allows the platform 12 to be tilted. A motor 68 and a threaded screw 70 are used for this purpose.

Vertical adjustment is provided by a motor 60 that is used to actuate an actuating rod 62 which is connected to the lower planar member 36. The motor 60 is supported by an interior support member 64. A rail 66 and guides attached to an extending member 76 aid in stabilizing the support platform 12.

As shown in FIG. 3, the motor 68 and the threaded screw drive 70 have been used to tilt the support platform 12. The motor 68 is fixedly attached to the lower planar member 36 and the threaded screw drive 70 extends through the lower member to connect to the middle planar member 34. The top planar member 32 is shown slid out from the middle planar member 34. To keep the top planar member 34 in a particular position, a groove arrangement 74 is used, however other means may be employed. Being able to adjust the distance between the keyboard and the VDT aids in providing both a physically and optically comfortable position.

Figure 4:
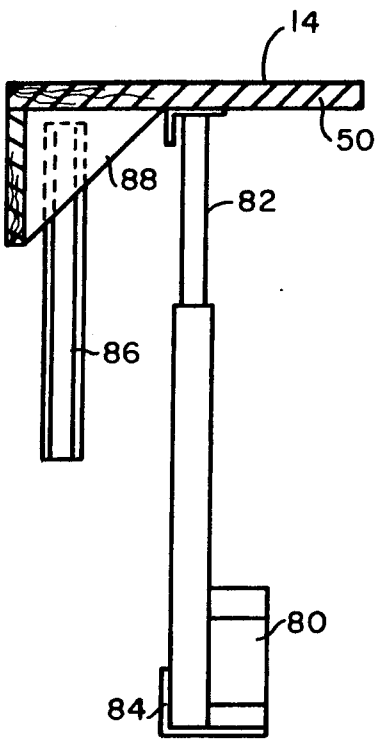
FIG. 4 is a side plan view of the monitor platform of FIG. 1.

Turning now to FIG. 4, the lift mechanism of the support platform 14 is shown to be similar to that of the keyboard platform 12. A motor 80 is used to actuate an actuating rod 82 connected to a planar member 50. The motor 80 is supported by an inner support member 84. A rail 86 and guide members attached to extension 88 are used to provide stability to the support platform 14. The weight supported by the support platform 14 is up to 75 lbs. Accordingly, the motor 80 needs to be sized to operate under those loads. A 12-volt DC motor is suitable. The motors 60 and 68 are also DC motors.

FIG. 5 is a simple block schematic of the switches and actuating motors. A power supply 100 typically uses voltages of 115 volts a.c. input to a power supply of a 12 volts d.c. output at a current rating of 7 amps used to power the actuator motor. A main power on/off switch 102 is used to turn the power on or off to the desk. A safety switch 104 is included so that it must be depressed concurrently with the other switches before a motor will be actuated. This is to prevent accidental adjustments from occuring as well as making it difficult for young children to play with the desk adjustments. The safety switch 104 is located near the right side of the keyboard 12 so that two-handed operation is required. Following the safety switch 104 is a selector switch 106 which is used to select the direction in which the platforms are to be adjusted. Once either the raise or lower direction is selected then the individual switches 108, 112 and 116 can be used to actuate the motors 60, 68 and 80 respectively.

We claim:

1. An adjustable desk for supporting a computer including a video display monitor and a keyboard, the desk comprising:

a pair of generally opposed upstanding side walls, defining sides of a desk, a horizontal top surface supported between the side walls, the top surface having a cutout section therein, the cutout section having forward and rearward portions in relation to a user of the desk, a first support platform for supporting a keyboard, the first platform occupying a forward portion of the cutout section of the top surface, first motive means associated with the first platform for adjusting the elevation of the first platform within a specified range, second motive means associated with the first platform for adjusting the tilt of the first platform, wherein said first platform includes a planar base member coupled to said first motive means, an intermediate planar member hingedly attached to the front of the base member and coupled to the second motive means, and a top planar member slideably coupled to the intermediate member, a second support platform rearward of the first support platform having a size capable of supporting a video display monitor, the second platform occupying a rearward portion of the cutout of the top surface, third motive means associated with the second support platform for adjusting the elevation of the second platform, and control means in communication with the first, second and third motive means for commanding the motive means to actuate thereby adjusting the positions of the first and second platforms.

2. The desk of claim 1 wherein said control means includes a separate switch for activating each of said motive means.

3. The desk of claim 2 further including a safety switch for enabling and disabling operation of said switches which activate the motive means.

4. The desk of claim 3 wherein said safety switch is located a distance from said switches for activating the motive means such that a two-handed operation is required.

5. The desk of claim 1 further comprising a side compartment for housing a computer base unit.

6. The desk of claim 1 further comprising a top surface area adjacent to said first and second support platforms, the top surface area being suitable for supporting peripheral devices and providing a desktop work area.

7. An adjustable desk for supporting a computer system including a video display monitor and a keyboard, the desk comprising, a pair of generally opposed upstanding side walls, a horizontal top surface supported between the side walls, the top surface having a cutout section therein, a first support platform adapted for supporting a keyboard, the first platform occupying a front portion of the cutout section of the top surface, the first platform including a planar base member hingedly attached to a planar intermediate member along their respective front edges, and further including a top planar member slideably coupled to the intermediate member, first motive means associated with the first support platform and coupled to the base member for adjusting the elevation of the first platform, second motive means fixedly associated with the base member and coupled to the intermediate member for adjusting the tilt of the first platform, a second support platform rearward of the first support platform and adapted for supporting a video display monitor, the second platform generally occupying a rear portion of the cutout section of the top surface, third motive means associated with the second platform for adjusting the elevation of the second platform, and control means in communication with the first, second and third motive means for commanding the motive means to actuate, and thereby adjust the positions of the first and second support platforms.

8. The desk of claim 7 wherein said control means includes a separate switch for activating each of said motive means.

9. The desk of claim 8 further including a safety switch for enabling and disenabling operation of said switches which activate the motive means.

10. The desk of claim 9 wherein said safety switch is located a distance from said switches for activating the motive means such that a two-handed operation is required.

11. The desk of claim 7 further comprising a side compartment for housing a computer base unit.

12. The desk of claim 7 further comprising a top surface area adjacent to said first and second support platforms, the top surface area being suitable for supporting peripheral devices and providing a desktop work area.

13. An adjustable desk for supporting a computer system including a base computer unit, a video display monitor and a keyboard, the desk comprising, a pair of spaced-apart and generally parallel upstanding end walls, an upstanding side wall being parallel to and located between the end walls and forming a side compartment with one of the end walls with a suitable size for housing a computer base unit, a horizontal top surface being supported by the end walls and having a generally centrally located cutout section therein, a first support platform adapted for supporting a keyboard, the first platform occupying a front portion of the cutout section of the top surface, the first platform including a planar base member hingedly attached to a planar intermediate member along their respective front edges, and further including a top planar member slideably coupled to the intermediate member, first motive means associated with the first support platform and coupled to the base member for adjusting the elevation of the first platform, second motive means fixedly associated with the base member and coupled to the intermediate member for adjusting the tilt of the first platform, a second support platform rearward of the first support platform and adapted for supporting a video display monitor, the second platform generally occupying a rear portion of the cutout section of the top surface, third motive means associated with the second platform for adjusting the elevation of the second platform, and control means in communication via separate switches with the first, second and third motive means for commanding the respective motive means to actuate, and thereby adjust the relative position of the first and second support platforms, the control means further including a safety switch for enabling and disenabling the separate switches.

* * * * *

UNITED STATES PATENT AND TRADEMARK OFFICE

CERTIFICATE OF CORRECTION

PATENT NO. : 5,101,736

DATED : April 7, 1992

INVENTOR(S) : Paul F. Bommarito et al.

It is certified that error appears in the above-identified patent and that said Letters Patent is hereby corrected as shown below:

ON THE TITLE PAGE

[76] Inventors: "Vincent A. Laporta" should read - -Vincent A. La Porta- -.

[57] Abstract, line 11, "are hingdly attached" should read - -are hingedly attached- -.

Column 2, lines 51-52, "American National Standards Institute/Humane Factors Society" should read - -American National Standards Institute/Human Factors Society- -.

Column 4, line 18, "tilted and slided position" should read - -tilted and slid position- -.

Claim 7, column 7, line 20, "slideably" should read - -slidably- -.

UNITED STATES PATENT AND TRADEMARK OFFICE

CERTIFICATE OF CORRECTION

PATENT NO. : 5,101,736

DATED : April 7, 1992

INVENTOR(S) : Paul F. Bommarito et al.

It is certified that error appears in the above-identified patent and that said Letters Patent is hereby corrected as shown below:

Claim 13, column 8, line 26, "slideable" should read --slidable--.

Signed and Sealed this

Tenth Day of August, 1993

*Attest:*

Michael K. Kirk

MICHAEL K. KIRK

*Attesting Officer*

*Acting Commissioner of Patents and Trademarks*